US005580190A

United States Patent [19]

Hsu

[11] Patent Number: 5,580,190

[45] Date of Patent: Dec. 3, 1996

[54] SOIL-HOLDING NET

[75] Inventor: Yu-Lien Hsu, Tien-Wei Hsiang, Taiwan

[73] Assignees: Woody Yang; Shin-Tsung Yang; Sheh-Ching Young, all of Taipei, Taiwan

[21] Appl. No.: 423,381

[22] Filed: Apr. 13, 1995

[51] Int. Cl.[6] ..... E02D 17/20

[52] U.S. Cl. ..... 405/258; 405/15

[58] Field of Search ..... 405/15, 16, 19, 405/21, 32, 258

[56] References Cited

U.S. PATENT DOCUMENTS 4,726,708 2/1988 Papetti ..... 405/19

5,039,250 8/1991 Janz ..... 405/16 X

FOREIGN PATENT DOCUMENTS 16730 2/1981 Japan ..... 405/15

3293 1/1982 Japan ..... 405/258

*Primary Examiner*—David J. Bagnell

*Attorney, Agent, or Firm*—Michael D. Bednarek; Kilpatrick & Cody

[57] ABSTRACT

A soil-holding device for holding soil dressing on a slope utilizes a water-permeable net paved on the slope. Also provided are a plurality of rows of ground-standing piles fixed on the slope for fastening the water-permeable net and a plurality of rows of soil-holding nets provided on the water-permeable net and correspondingly supported by the ground-standing piles.

9 Claims, 13 Drawing Sheets

SOIL-HOLDING NET

BACKGROUND OF THE INVENTION

1. Field of the Invention

The present invention relates to a soil-holding means, especially to a soil-holding means that performs well in holding the soil dressing on hill slopes.

2. Description of Prior Art

Soil dressing vegetation is a very important technique in the field of the soil conservation. Such soil dressing is provided on hill slopes to improve the natural environment when the hill slopes are not suitable for the growth of plants. However, the soil dressing provided on the hill slopes is easily washed away if it rains. Therefore, many soil-holding means have been developed to hold the soil dressing on the slopes.

FIG. 1 is a schematic diagram of a conventional contour-type soil-holding means. A plurality of independent ground-standing piles 1003 are arranged in rows along the contour lines of a slope 1000. Each row of ground-standing piles 1003 is connected with a soil-holding fence 1002 for fixing soil-holding nets 1001 which are utilized to hold the soil dressing paved on the slope 1000.

Referring to FIG. 2, there is shown a conventional square-type soil-holding means. A plurality of square net units 2001, formed by interlinked soil-holding nets 2002, are provided on a slope 1000 for holding the soil dressing therein. The square net units 2001 are supported by independent ground-standing piles 2003 at their corners.

A conventional honeycomb-type soil-holding means is similar to the square-type soil-holding means and is shown in FIG. 3, in which a plurality of hexangular net units 3001, formed by interlinked soil-holding nets 3002, are provided on a slope 1000 for holding the soil dressing therein. Each of the hexangular net units 3001 are supported by a couple of independent ground-standing piles 3003 at their corners.

However, all the conventional soil-holding means have a common problem—parts of the soil dressing can leak from the slits between the soil-holding nets and the slope. This leakage is intensified when it rains.

SUMMARY OF THE INVENTION

An object of the present invention is to provide a soil-holding means which performs well at holding the soil dressing on hill slopes.

In accordance with the object of the present invention, there is provided a soil-holding means for holding soil dressing on a slope. The soil-holding means comprises a water-permeable net paved on the slope; a plurality of rows of ground-standing piles fixed on the slope for fastening the water-permeable net; and a plurality of rows of soil-holding nets provided on the water-permeable net and correspondingly supported by the ground-standing piles.

Alternatively, there is provided a soil-holding means for holding soil dressing on a slope. The soil-holding means comprises a plurality of net units for holding the soil dressing and a plurality of ground-standing piles. The net units comprise a bottom paved on the slope and a plurality of interlinked soil-holding nets connected onto the bottom. Also the ground-standing piles are fixed on the slope for supporting and fastening the net units.

BRIEF DESCRIPTION OF THE DRAWINGS

The present invention can be more fully understood by reading the subsequent detailed description and examples with references made to accompanying drawings, wherein.

DETAILED DESCRIPTION OF THE INVENTION

Figure 1:
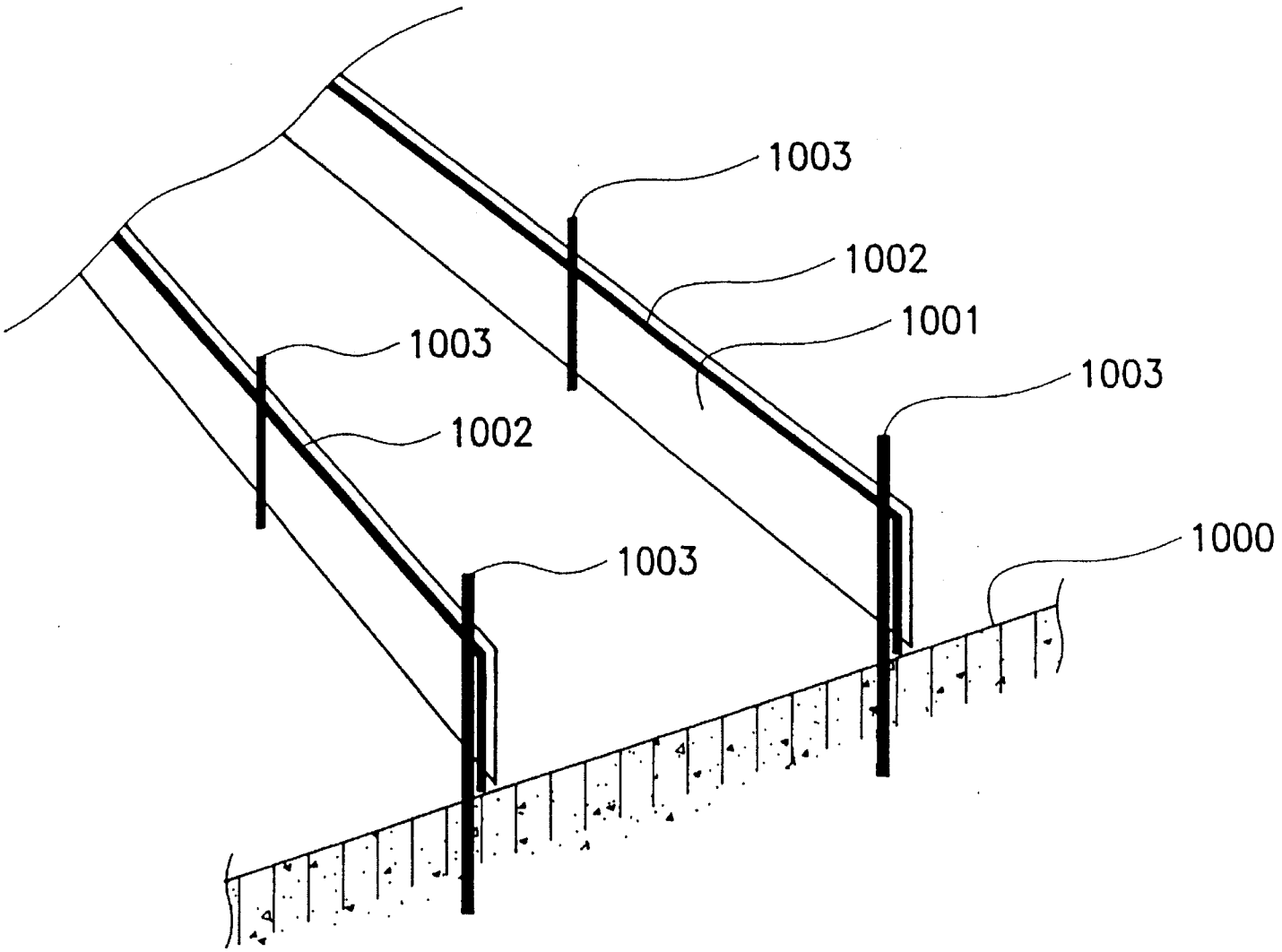
FIG. 1 (PRIOR ART)
FIG. 1 shows a conventional contour-type soil-holding means.
Figure 2:
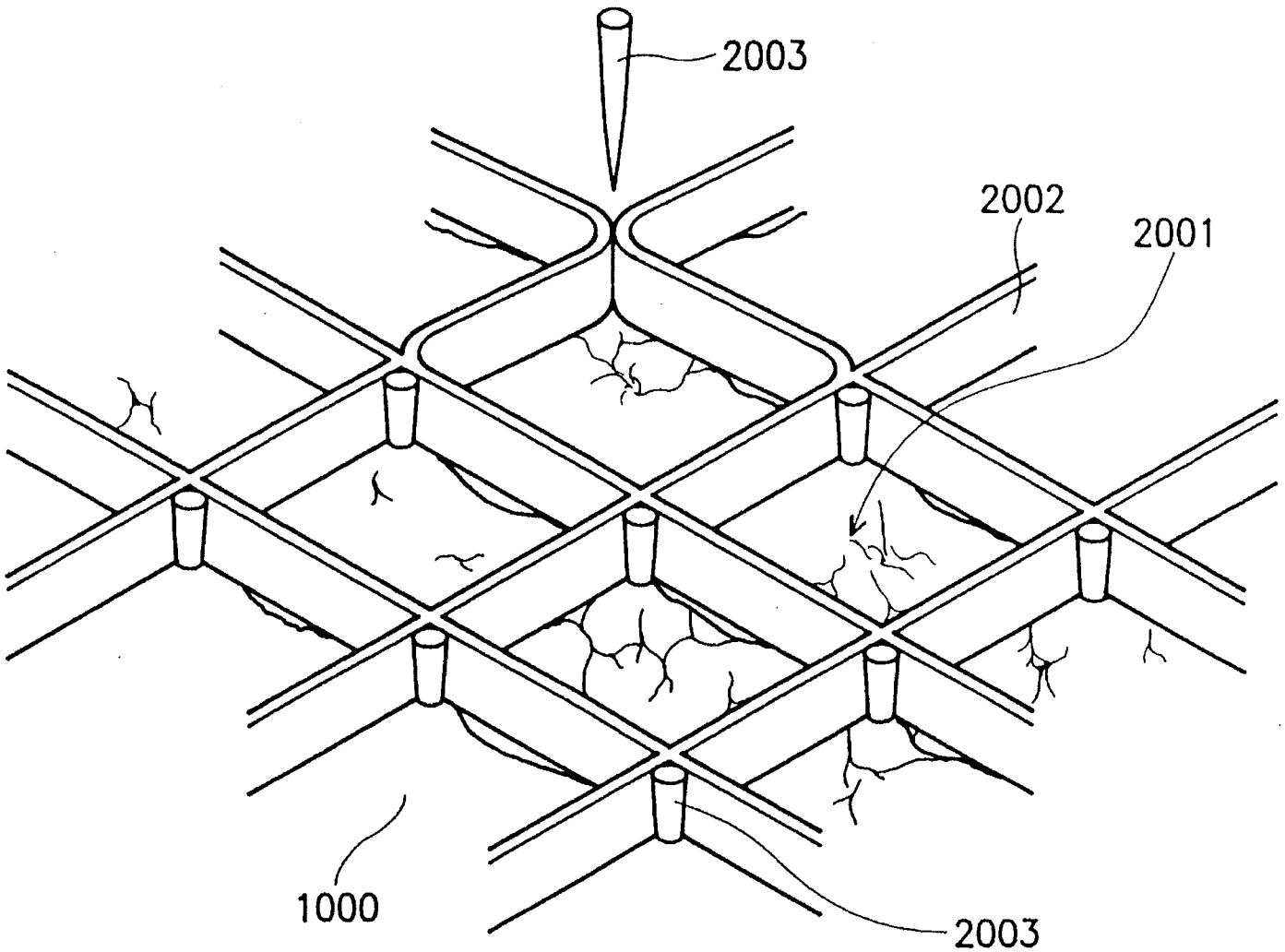
FIG. 2 (PRIOR ART)
FIG. 2 shows a conventional square-type soil-holding means.
Figure 3:
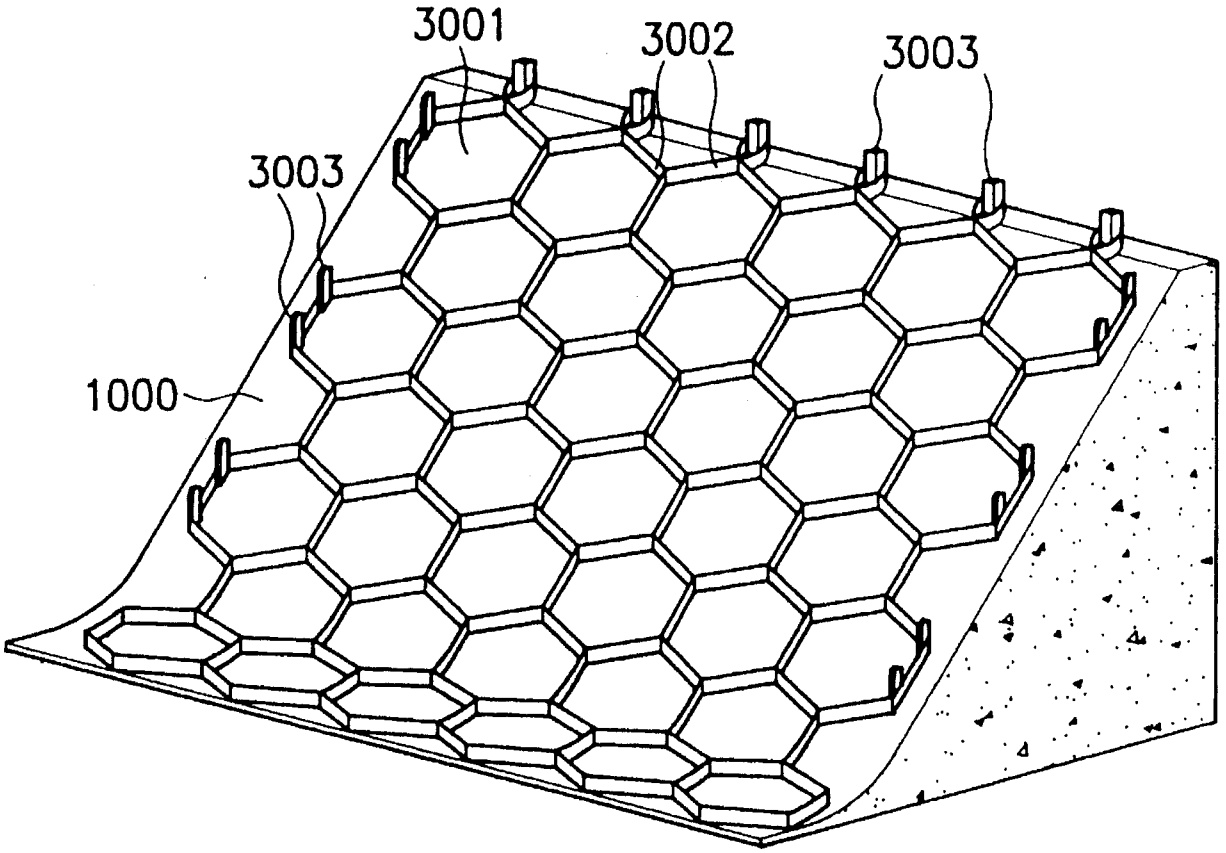
FIG. 3 (PRIOR ART)
FIG. 3 shows a conventional honeycomb-type soil-holding means.
Figure 4:
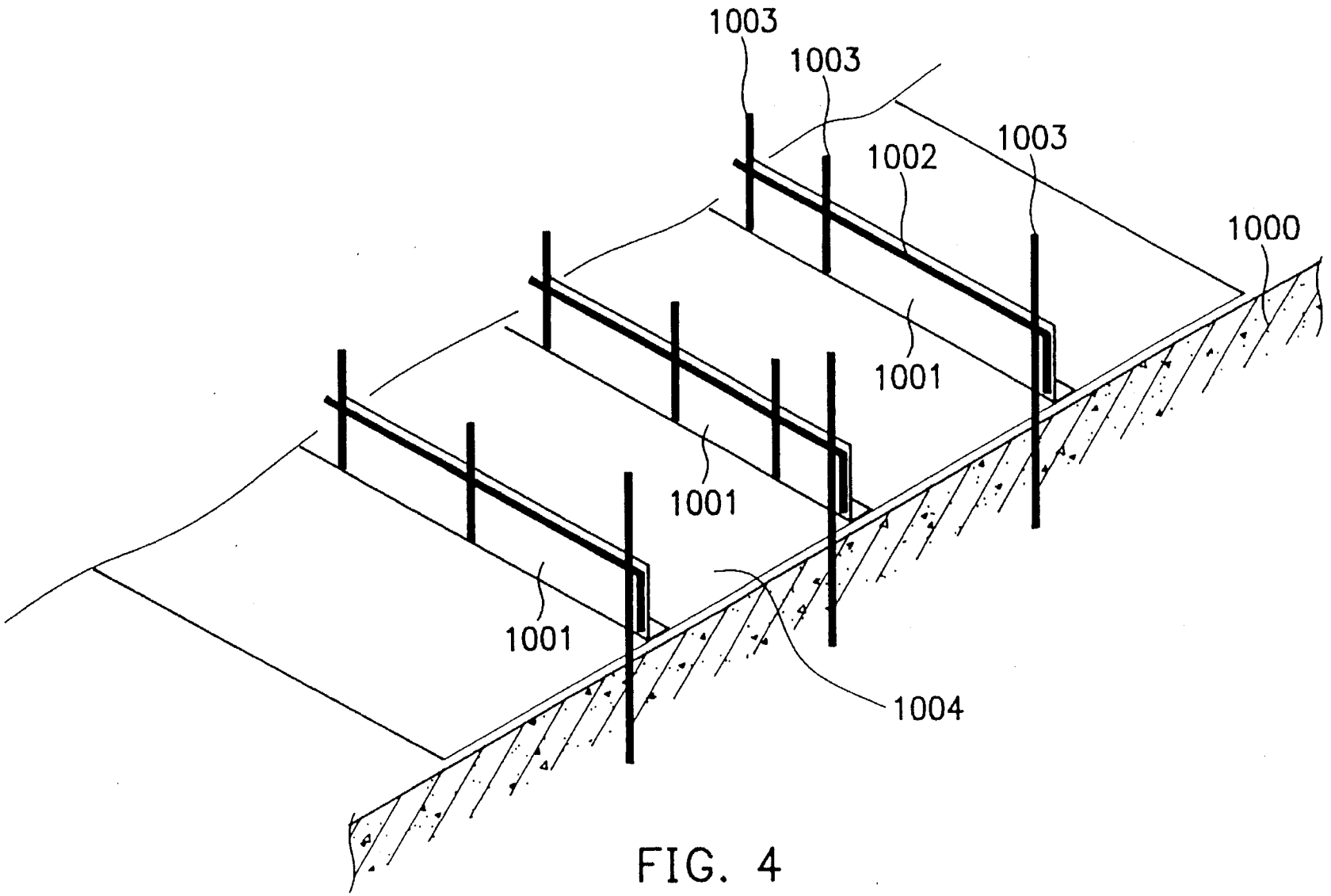
FIG. 4 is a schematic diagram of the soil-holding means according to a first embodiment of this invention.

FIG. 4 is the schematic diagram of the soil-holding means according to the first embodiment of this invention. A water-permeable net 1004 with a plurality of soil-holding nets 1001 sewed thereon is paved on a slope 1000, wherein the soil-holding nets 1001 and the water-permeable net 1004 are made of the same material. A plurality of independent ground-standing piles 1003, corresponding to each of the soil-holding nets 1001, are driven into the slope 1000 through the water-permeable net 1004 and are connected with soil-holding fences 1002 for fixing the soil-holding nets 1001. The soil dressing is provided on the water-permeable net 1004 and held between each of two soil-holding nets 1001. Because the soil-holding nets 1001 are sewed on the water-permeable net 1004, no slit exists therebetween. The problem of leakage is thus solved.

It is noted that sewing the soil-holding nets on the water-permeable net can be done in advance rather than on the hill slopes.

Figure 5:
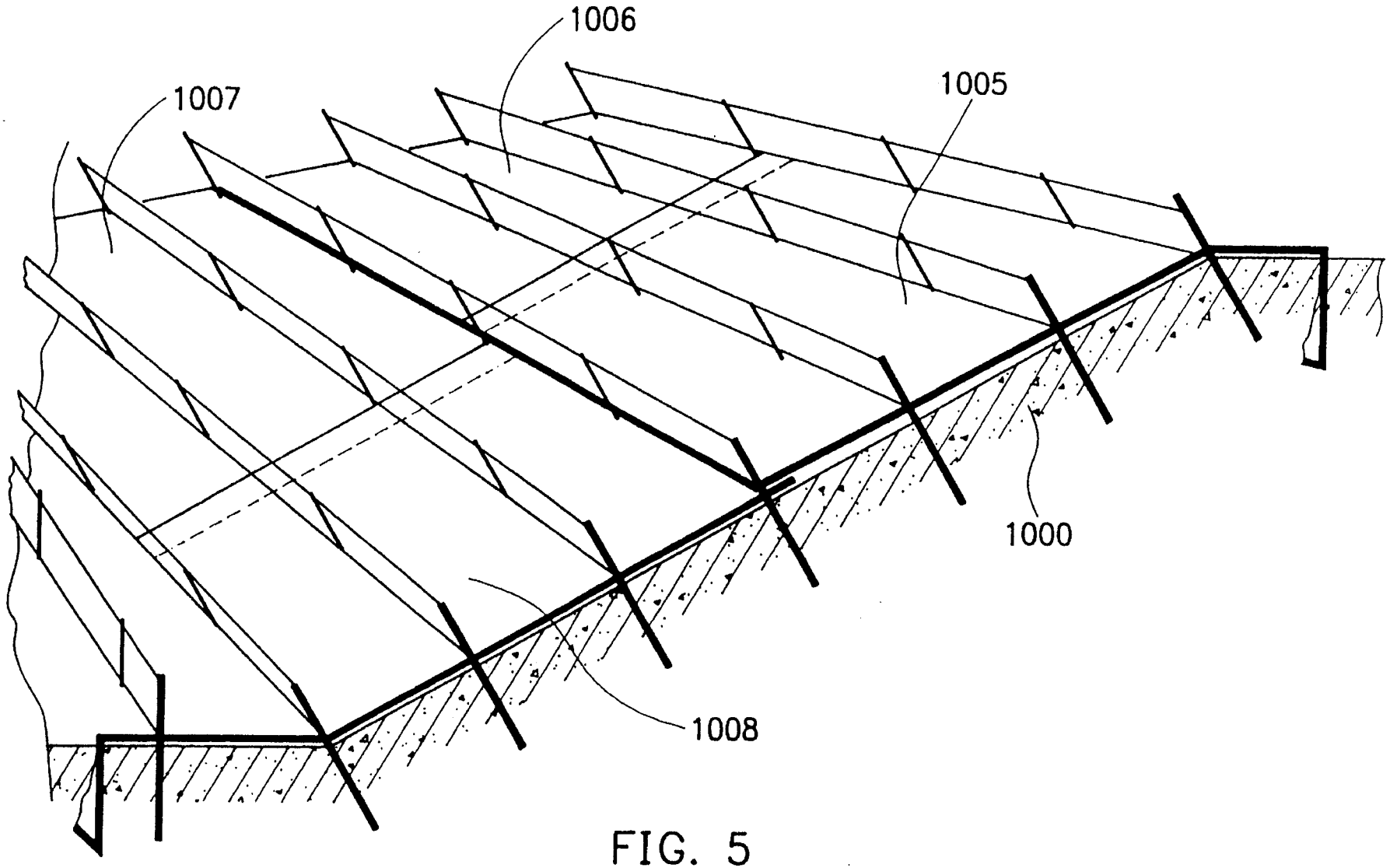
FIG. 5 shows the soil-holding means according to the first embodiment, wherein four water-permeable nets are connected together and paved on a hill slope.

In practice a plurality of water-permeable nets are always connected together to supply a large enough size for covering the hill slopes. As shown in FIG. 5, the slope 1000 is covered with four connected water-permeable nets 1005, 1006, 1007, 1008.

Figure 6:
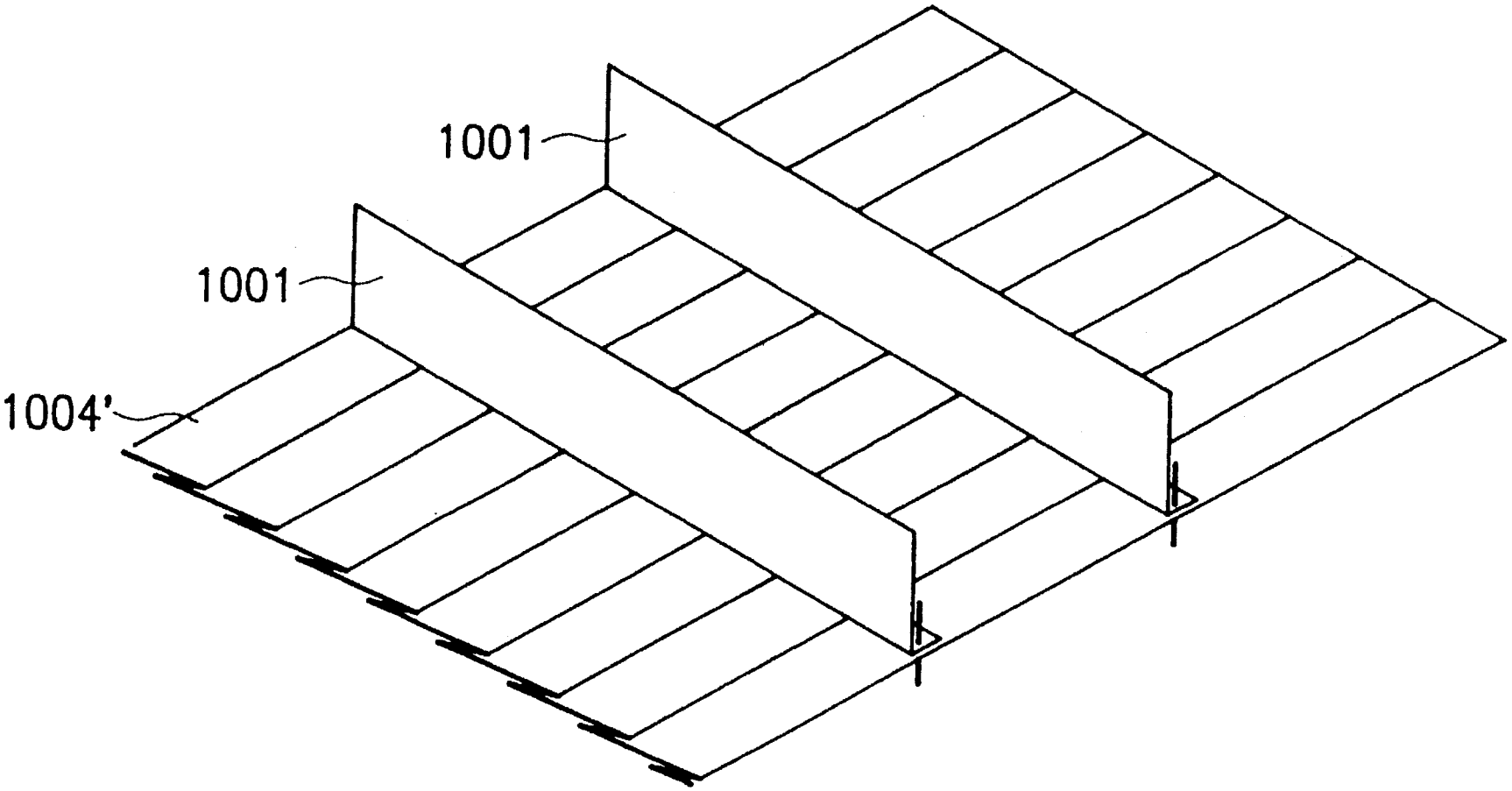
FIG. 6 shows a variation of the first embodiment, wherein a water-permeable net is provided with creases.

FIG. 6 shows a variation of the first embodiment, wherein the water-permeable net 1004' is provided with creases. The arrangement makes the water-permeable net 1004' extensible if the hill slopes are not even.

Figure 7:
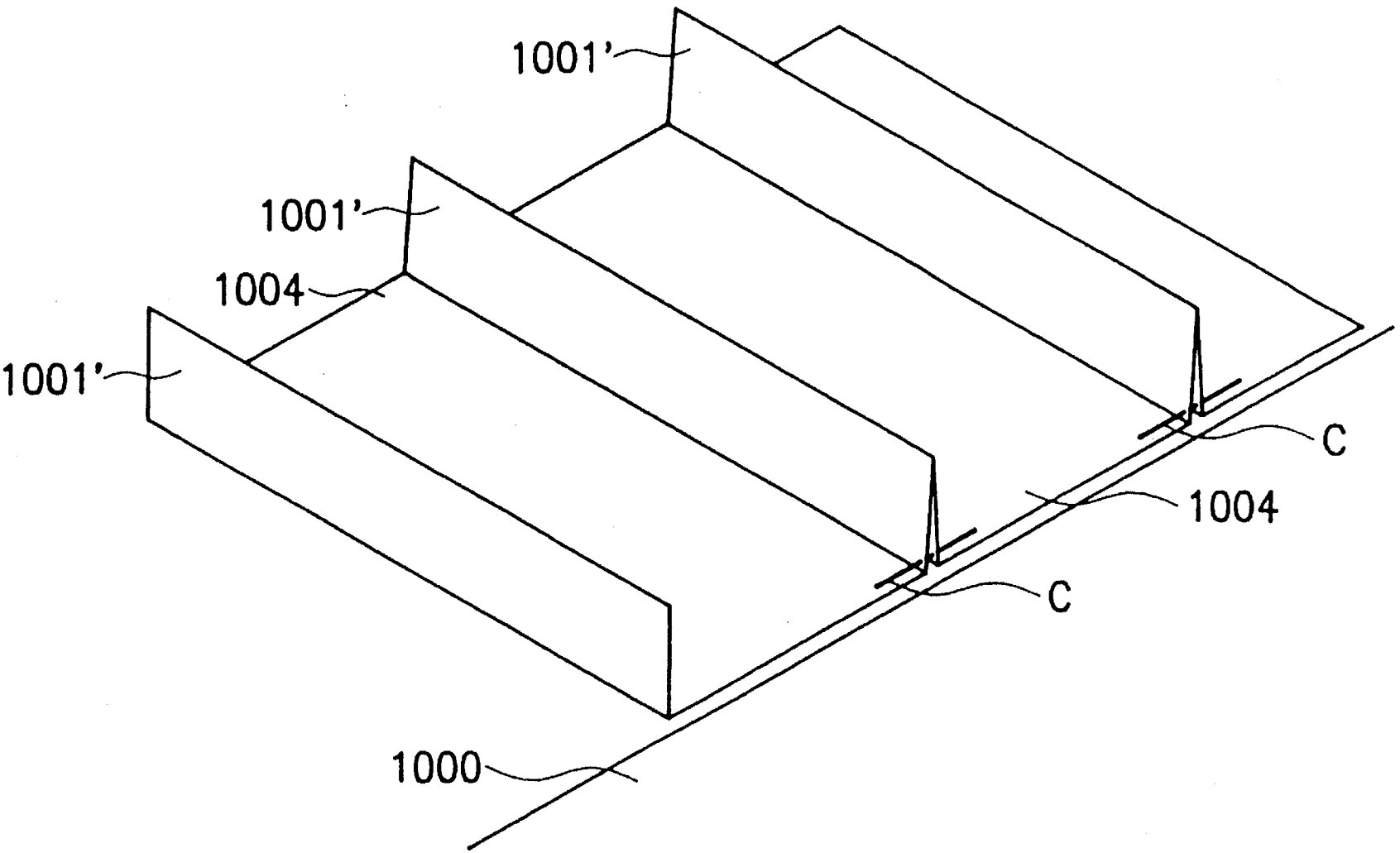
FIG. 7 shows another variation of the first embodiment, wherein soil-holding nets are formed by directly folding a water-permeable net.
Figure 8:
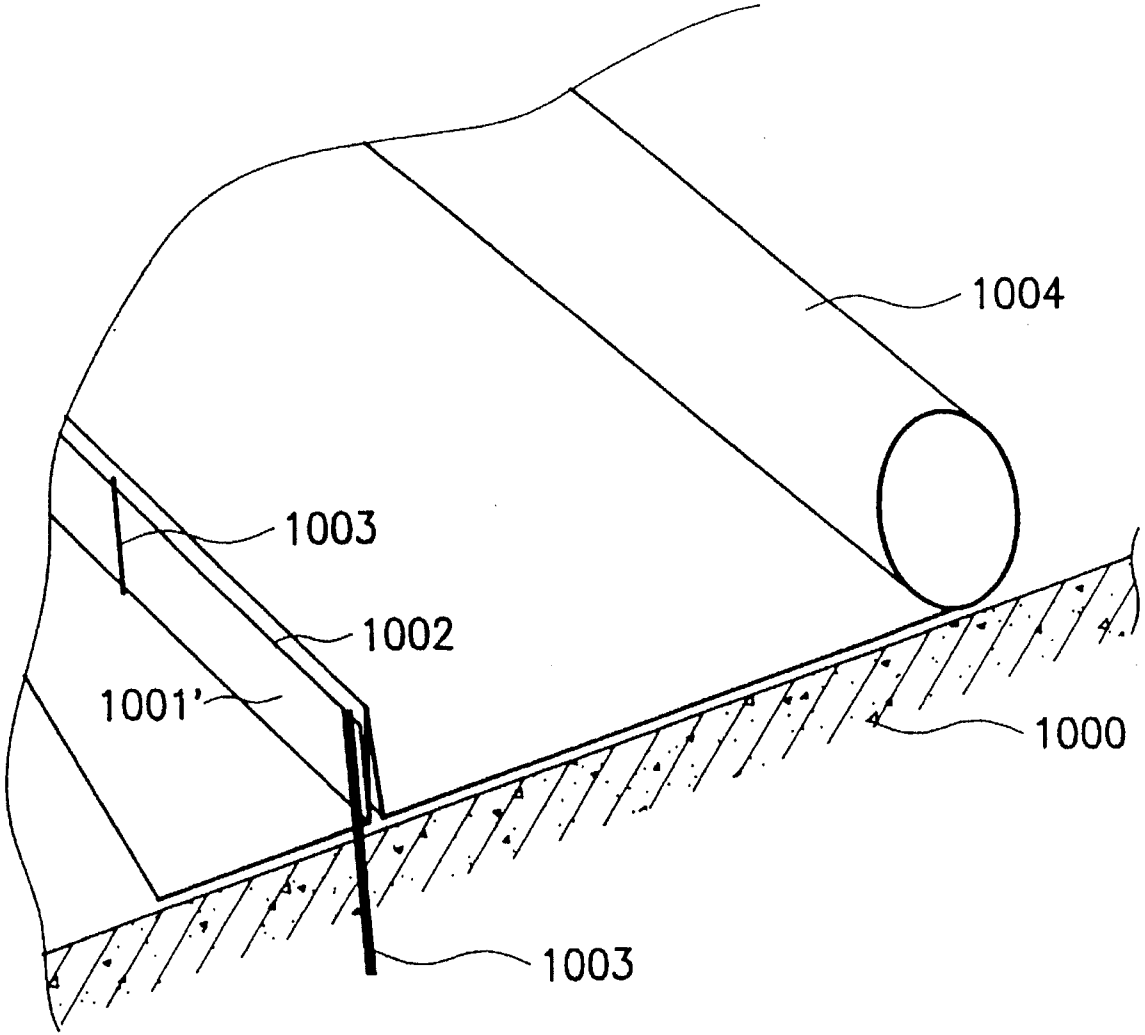
FIG. 8 shows a method of constructing the soil-holding means according to FIG. 7.

FIG. 7 shows another variation of the first embodiment, wherein the soil-holding nets 1001' are formed by directly folding the water-permeable net 1004. Also, the bottoms of each of the soil-holding nets 1001' are sewed together (indicated by the sign C). FIG. 8 shows a method of constructing the soil-holding means on a hill slope 1000. The construction method comprises:

(1) a roll of water-permeable net 1004 is spread out and paved on the slope 1000;

(2) a plurality of ground-standing piles 1003 are provided along a contour line of the slope 1000 and driven into the slope 1000 through the water-permeable net 1004;

(3) the ground-standing piles 1003 are connected with soil-holding fences 1002;

(4) the water-permeable net 1004 is pulled and folded to form a soil-holding net 1001 corresponding to the ground-standing piles 1003;

(5) the soil-holding net 1001 is sewed at its bottom and fixed to the soil-holding fences 1002 at its top; and (6) the steps (2)–(5) are repeated until the soil-holding means is completed.

Figure 9:
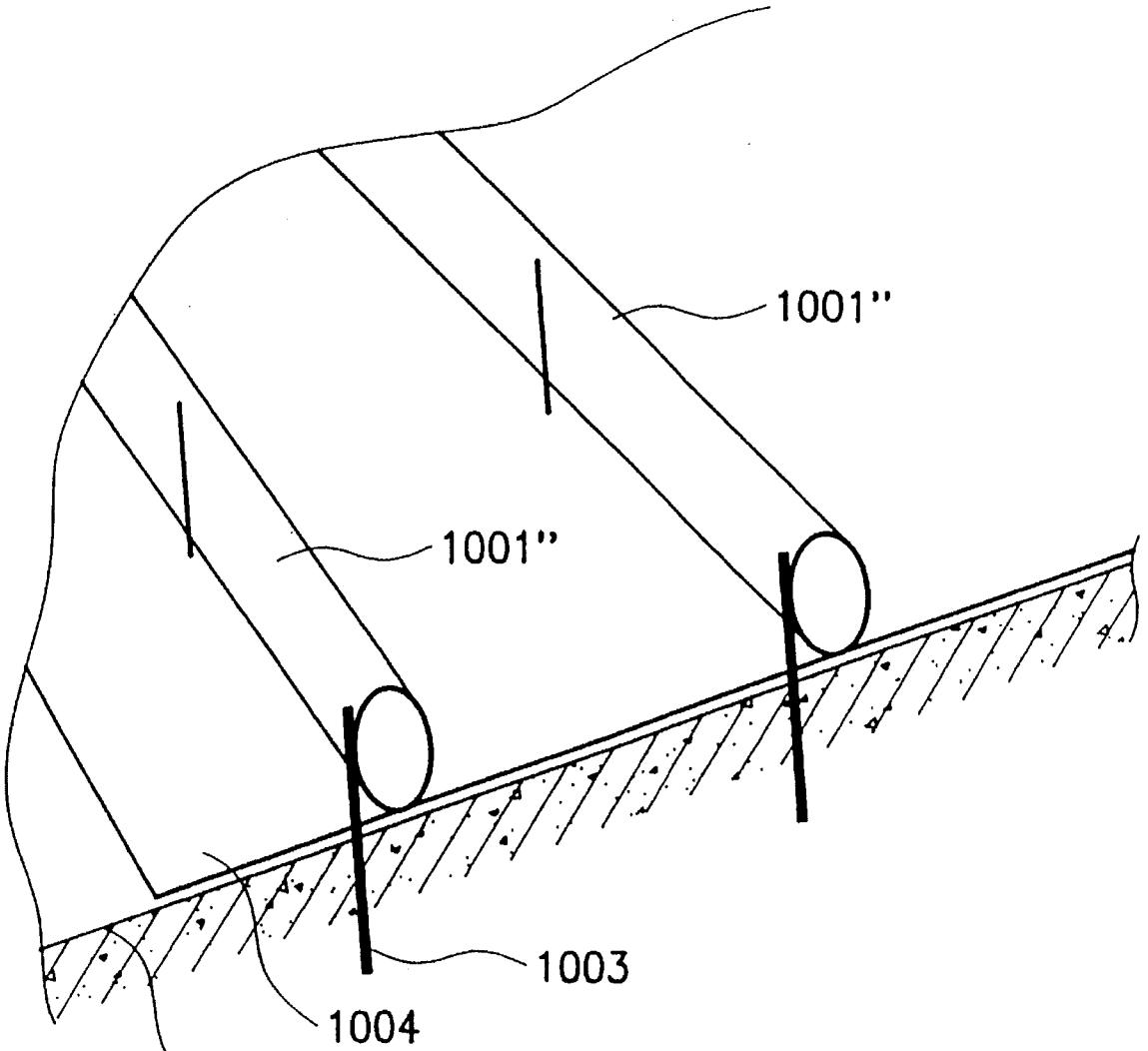
FIG. 9 shows a further variation of the first embodiment, wherein soil-holding nets are substantially cylindrical and directly supported by ground-standing piles.

FIG. 9 shows a further variation of the first embodiment, in which the soil-holding means has no soil-holding fences and the soil-holding nets 1001" are directly supported by the ground-standing piles 1003. The soil-holding nets 1001" are substantially cylindrical with soft material (such as sponges, cloths) stuffed therein. This arrangement can adapt the soil-holding means to the uneven slope. The method of constructing the soil-holding means on a hill slope 1000 is as follows:

(1) a water-permeable net 1004 is spread out and paved on the slope 1000;

(2) a plurality of ground-standing piles 1003 are provided along a contour line of the slope 1000 and driven into the slope 1000 through the water-permeable net 1004;

(3) the water-permeable net 1004 is pulled to form a soil-holding net 1001" corresponding to the ground-standing piles 1003;

(4) the soil-holding net 1001" is sewed at its bottom and stuffed with soft material; and (5) the steps (2)–(4) are repeated until the soil-holding means is completed.

Figure 10:
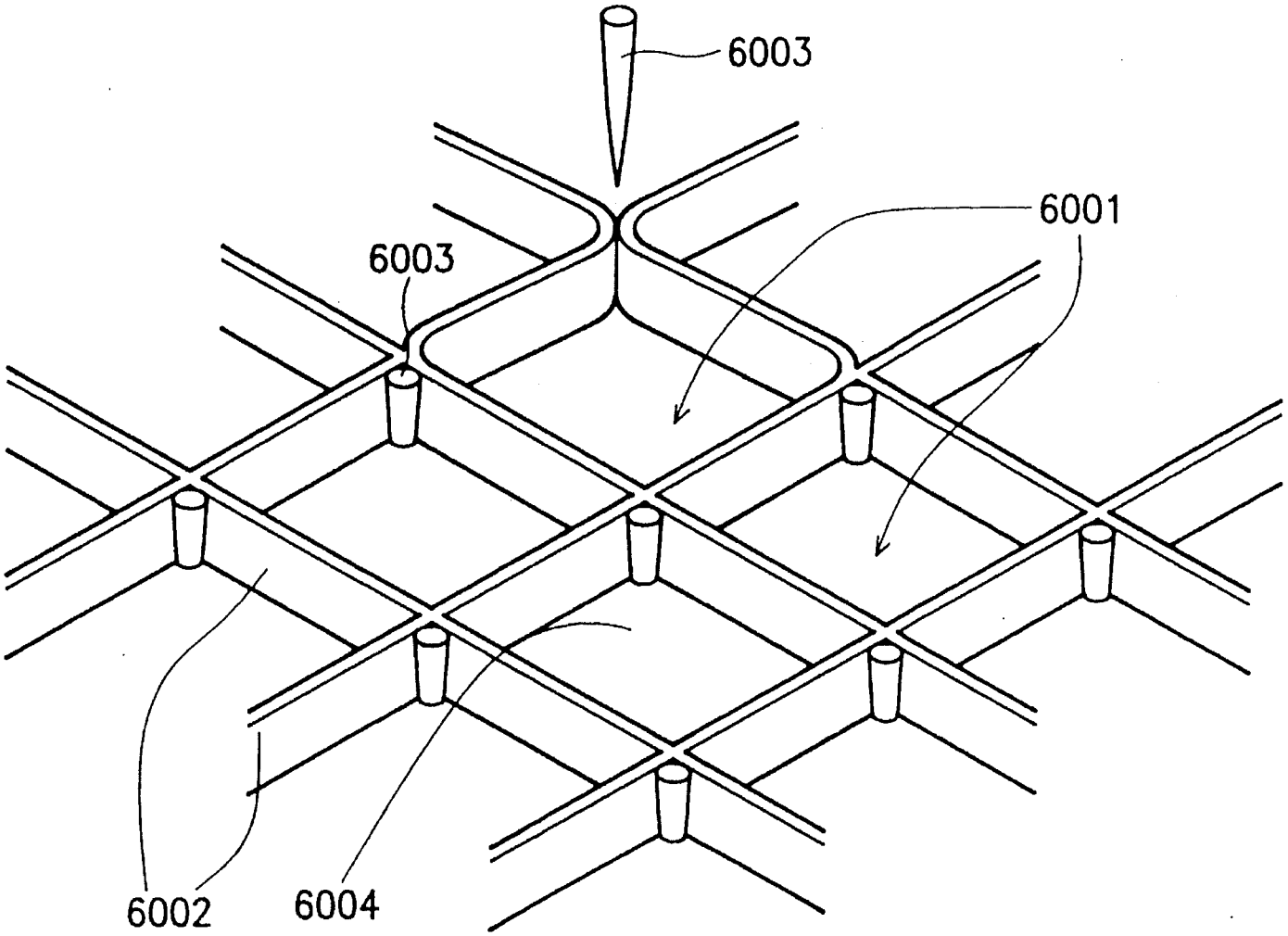
FIG. 10 shows a soil-holding means according to a second embodiment of this invention.
Figure 11:
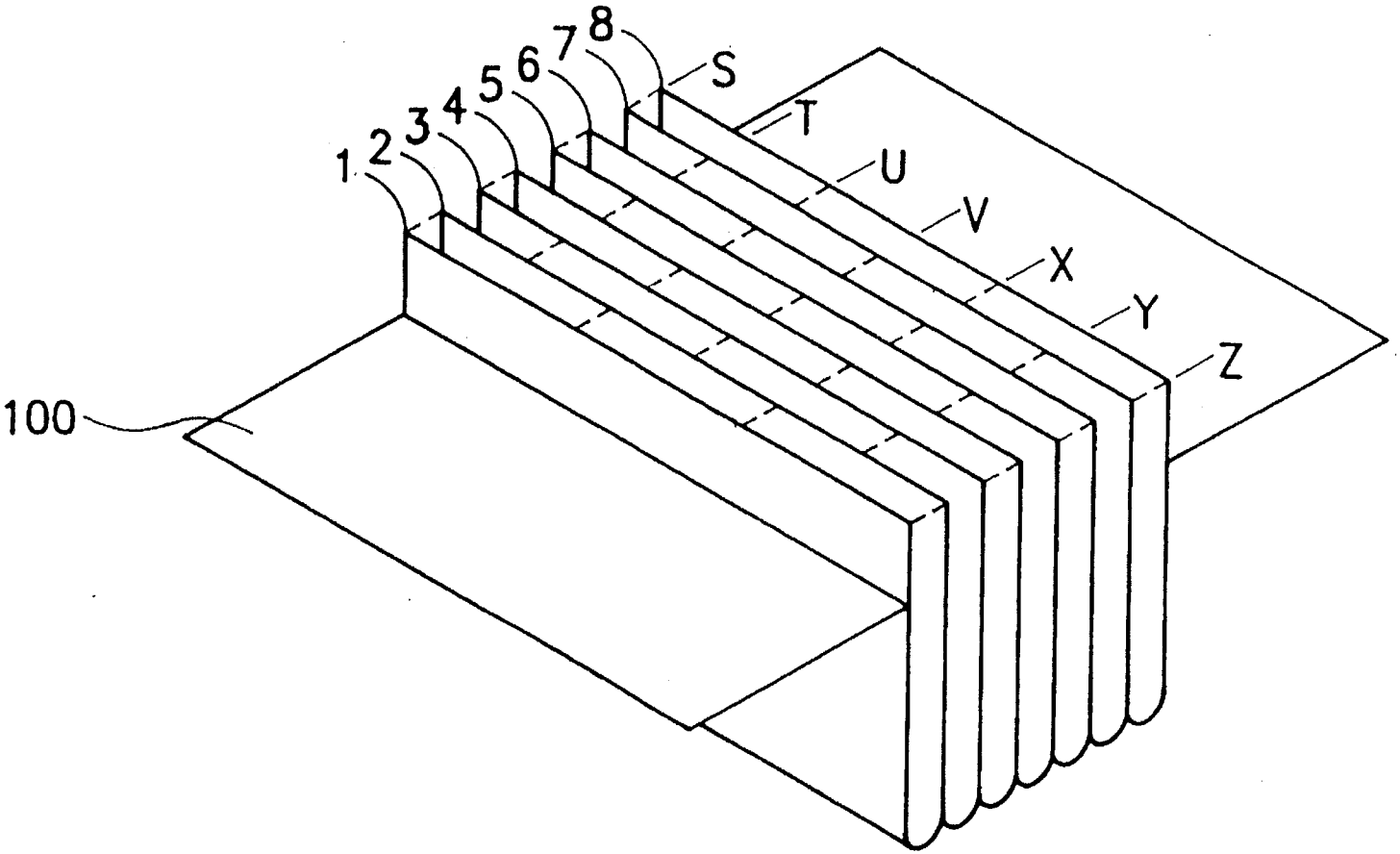
FIG. 11 shows a method of making the square net units according to FIG. 10 by sewing a water-permeable net.

FIG. 10 shows a soil-holding means according to the second embodiment of this invention. The soil-holding means comprises a plurality of square net units 6001 and ground-standing piles 6003, wherein the square net units 6001 comprise a bottom 6004 and a plurality of interlinked soil-holding nets 6002 connected onto the bottom 6004. FIG. 11 shows the method of making the square net units 6001 by sewing a water-permeable net 100. First the water-permeable net 100 is folded into a plurality of rows, for example, eight rows 1, 2, 3, 4, 5, 6, 7, 8. Then the upper portions of the rows 1–8 are sewed together according to the following method:

each of the rows 1–8 are defined as several equal parts, and the number of the equal parts is necessarily a multiple of two, for example, six, by marking the rows 1–8 at the positions S, T, U, V, W, X, Y, Z;

the rows 1 and 2 are sewed together at the positions S, U, X, Z, which are represented with the dotted lines;

the rows 2 and 3 are sewed together at positions T, U, Y;

the rows 3 arid 4 are sewed like the rows 1 and 2;

the rows 4 and 5 are sewed like the rows 2 and 3; and the rest of the rows are sewed together by analogy, thereby forming square net units.

The sewed water-permeable net 100 is spread out and paved on a slope, as shown in FIG. 10, each of the square net units 6001 are provided with a ground-standing pile 6003 at each of their corners. The ground-standing piles 6003 can support and fasten the square net units 6001 on the slope.

Figure 12:
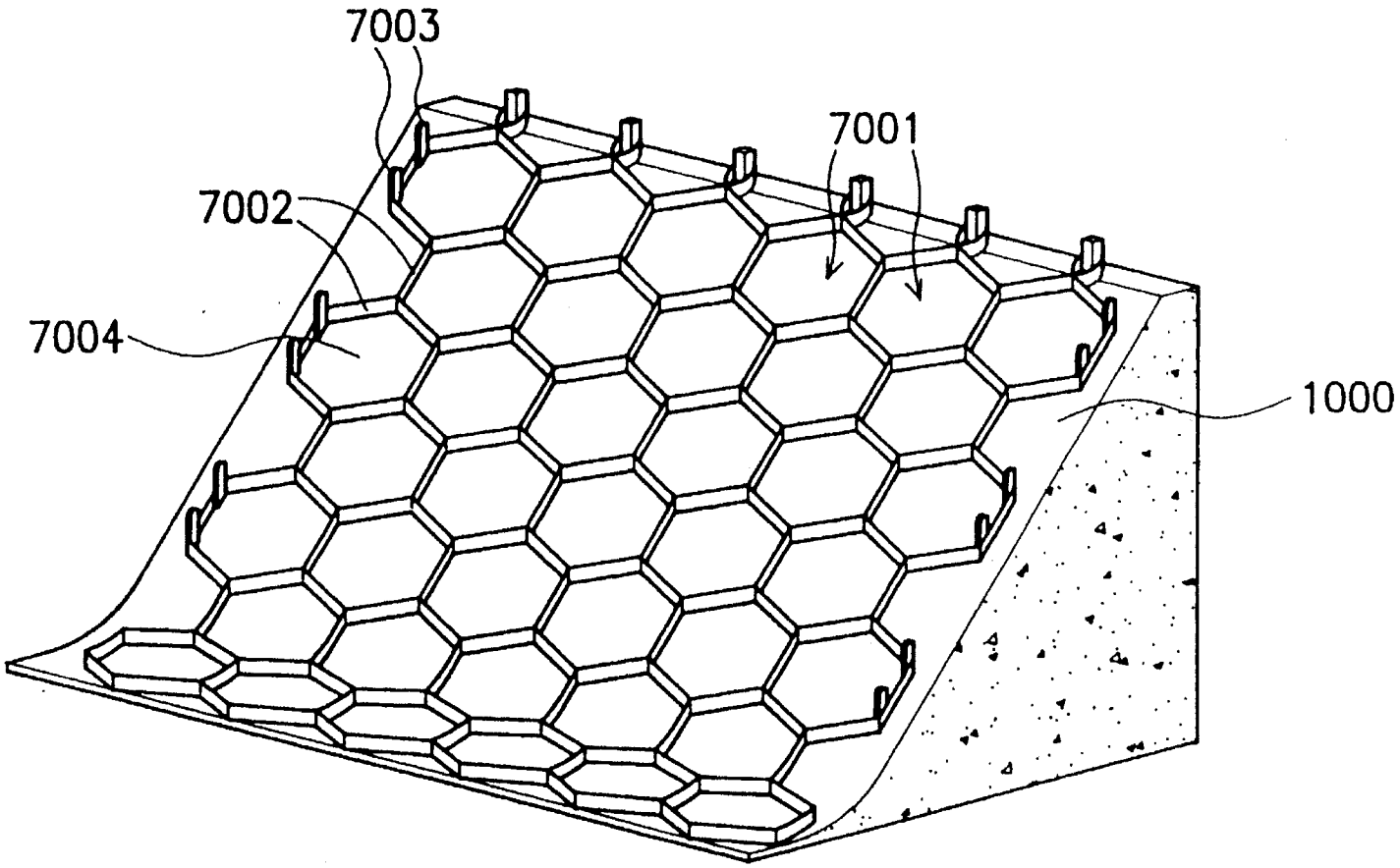
FIG. 12 shows a soil-holding means according to the third embodiment of this invention.
Figure 13:
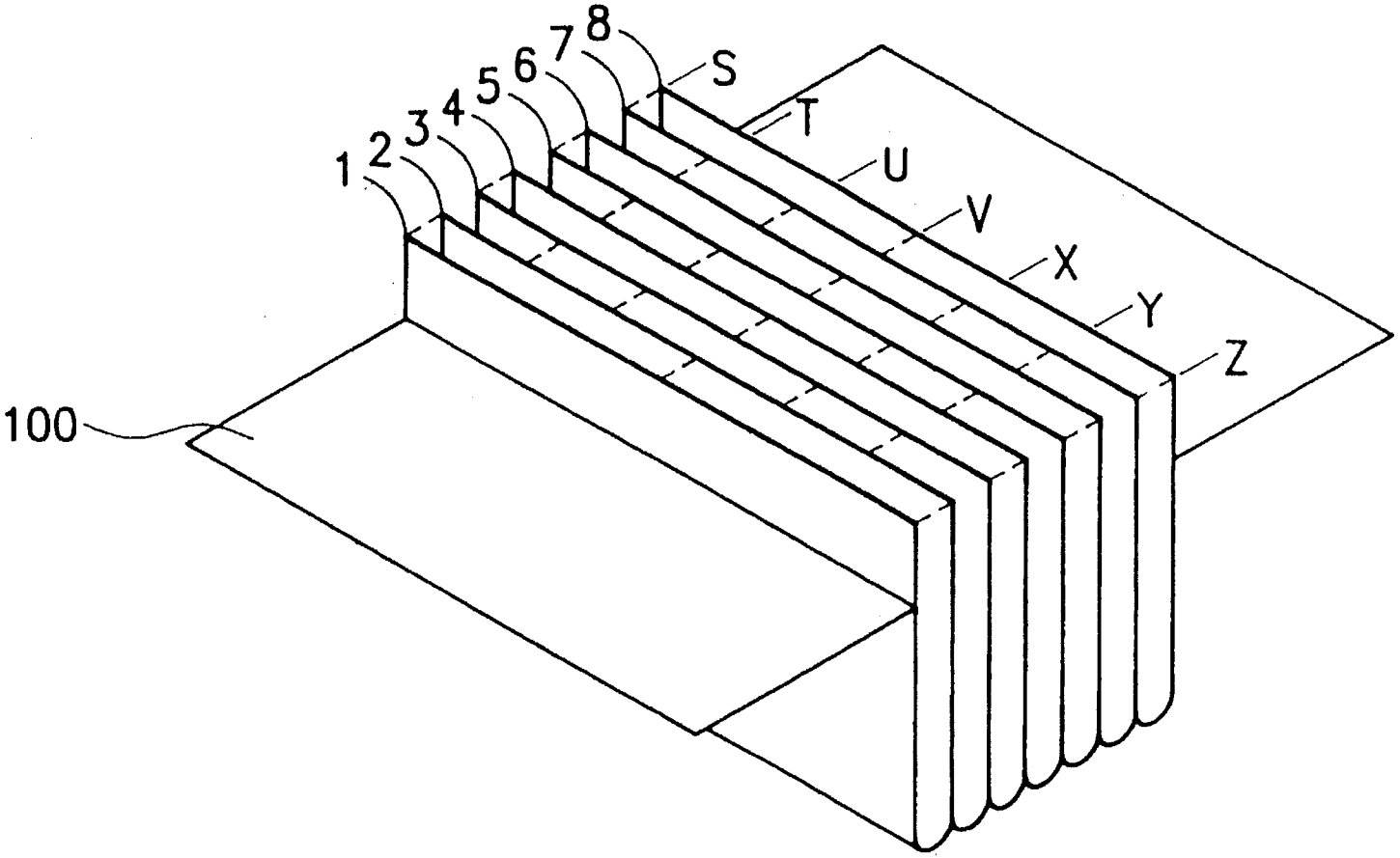
FIG. 13 shows a method of making the hexangular net units according to FIG. 12 by sewing a water-permeable net.

FIG. 12 shows a soil-holding means according to the third embodiment of this invention. The soil-holding means comprises a plurality of hexangular net units 7001 and ground-standing piles 7003, wherein the hexangular net units 7001 comprise a bottom 7004 and a plurality of interlinked soil-holding nets 7002 connected onto the bottom 7004. FIG. 13 depicts the method for making the hexangular net units 7001 by sewing a water-permeable net 100. First, the water-permeable net 100 is folded into a plurality of rows, for example, eight rows 1, 2, 3, 4, 5, 6, 7, 8. The upper portions of the rows 1–8 are then sewed together according to the following method:

each of the rows 1–8 are defined as several equal parts, and the number of the equal parts is necessarily a multiple of three, for example, six, by marking the rows 1–8 at the positions S, T, U, V, W, X, Y, Z;

the rows 1 and 2 are sewed together at the positions S, V, Z, which is represented with the dotted lines;

the rows 2 and 3 are sewed together at positions T, U, X, Y;

the rows 3 and 4 are sewed like the rows 1 and 2;

the rows 4 and 5 are sewed like the rows 2 and 3; and the rest of the rows are sewed together by analogy, thereby forming hexangular net units.

The sewed water-permeable net 100 is spread out and paved on a slope 1000, as shown in FIG. 12, each of the square net units 7001 are provided with a couple of ground-standing piles 7003 at their corners.

Although this invention has been described in its preferred forms and various examples with a certain degree of particularity, it is understood that the present disclosure of the preferred forms and the various examples can be changed in the details of construction. The scope of the invention should be determined by the appended claims and not by the specific examples given.

What is claimed is:

1. A soil-holding means for holding soil dressing on a slope, comprising:

a water-permeable net paved on the slope;

a plurality of rows of ground-standing piles fixed on the slope for fastening the water-permeable net; and a plurality of rows of soil-holding nets provided on the water-permeable net and correspondingly supported by the ground-standing piles.

2. A soil-holding means as claimed in claim 1, wherein the plurality of rows of ground-standing piles are fixed along the contour lines of the slope.

3. A soil-holding means as claimed in claim 1, further comprising a plurality of soil-holding fences, to which each row of the ground-standing piles is connected, for fixing the soil-holding nets.

4. A soil-holding means as claimed in claim 3, wherein the water-permeable net is provided with creases.

5. A soil-holding means for holding soil dressing on a slope, comprising:

a water-permeable net paved on the slope;

a plurality of rows of ground-standing piles fixed on the slope for fastening the water-permeable net; and a plurality of rows of soil-holding nets provided on the water-permeable net and correspondingly supported by the ground-standing piles, wherein the soil-holding nets are substantially cylindrical.

6. A soil-holding means for holding soil dressing on a slope, comprising:

a plurality of net units for holding the soil dressing, comprising a bottom paved on the slope; and a plurality of interlinked soil-holding nets connected onto the bottom; and a plurality of ground-standing piles fixed on the slope for supporting and fastening the net units.

7. A soil-holding means as claimed in claim 6, wherein the net units are square.

8. A soil-holding means as claimed in claim 7, wherein the ground-standing piles are correspondingly provided at the corners of the net units.

9. A soil-holding means for holding soil dressing on a slope, comprising:

a plurality of net units for holding the soil dressing, comprising a bottom paved on the slope; and a plurality of interlinked soil-holding nets connected onto the bottom; and a plurality of ground-standing piles fixed on the slope for supporting and fastening the net units;

wherein the net units are hexangular.

* * * * *